United States Patent [19]

Realmuto

[11] Patent Number: 4,724,981

[45] Date of Patent: Feb. 16, 1988

[54] DISPENSER AND METHOD FOR TRANSPORTING POURABLE MATERIALS

[76] Inventor: Peter P. Realmuto, 4930 Coldwater Canyon Ave., Sherman Oaks, Calif. 91403

[21] Appl. No.: 4,811

[22] Filed: Jan. 9, 1987

Related U.S. Application Data

[63] Continuation of Ser. No. 774,062, Sep. 9, 1985, abandoned.

[51] Int. Cl.[4] ..... B67B 7/26

[52] U.S. Cl. ..... 222/90; 222/569

[58] Field of Search ..... 222/80, 90, 87, 88, 222/91, 569, 570, 567; 220/85 SP

[56] References Cited

U.S. PATENT DOCUMENTS

| | | | |
|---|---|---|---|
| 503,666 | 8/1873 | Mott | 222/90 |
| 1,145,778 | 7/1915 | McCrystle | 222/90 |
| 2,245,698 | 6/1939 | Miller | 221/23 |
| 2,267,159 | 12/1941 | Lopes, Jr. | 221/23 |
| 2,552,155 | 5/1948 | Danielson | 222/81 |
| 2,751,119 | 6/1956 | Manning, Sr. | 222/81 |
| 3,305,135 | 2/1965 | Lemoine | 222/90 |
| 3,337,097 | 8/1967 | Day | 222/567 |
| 3,599,836 | 8/1971 | Hegi | 222/90 |
| 4,483,464 | 11/1984 | Nomura | 222/81 |

FOREIGN PATENT DOCUMENTS

| | | | |
|---|---|---|---|
| 776024 | 5/1957 | United Kingdom | 222/569 |

*Primary Examiner*—F. J. Bartuska
*Assistant Examiner*—Kenneth Noland
*Attorney, Agent, or Firm*—Kenyon & Kenyon

[57] ABSTRACT

A dispenser and method for using the dispenser to transport pourable materials. A dispenser is imbedded into a container wall and manipulated so as to seal the dispenser to the container. Pourable material may then be transported through the container wall via the dispenser.

3 Claims, 1 Drawing Figure

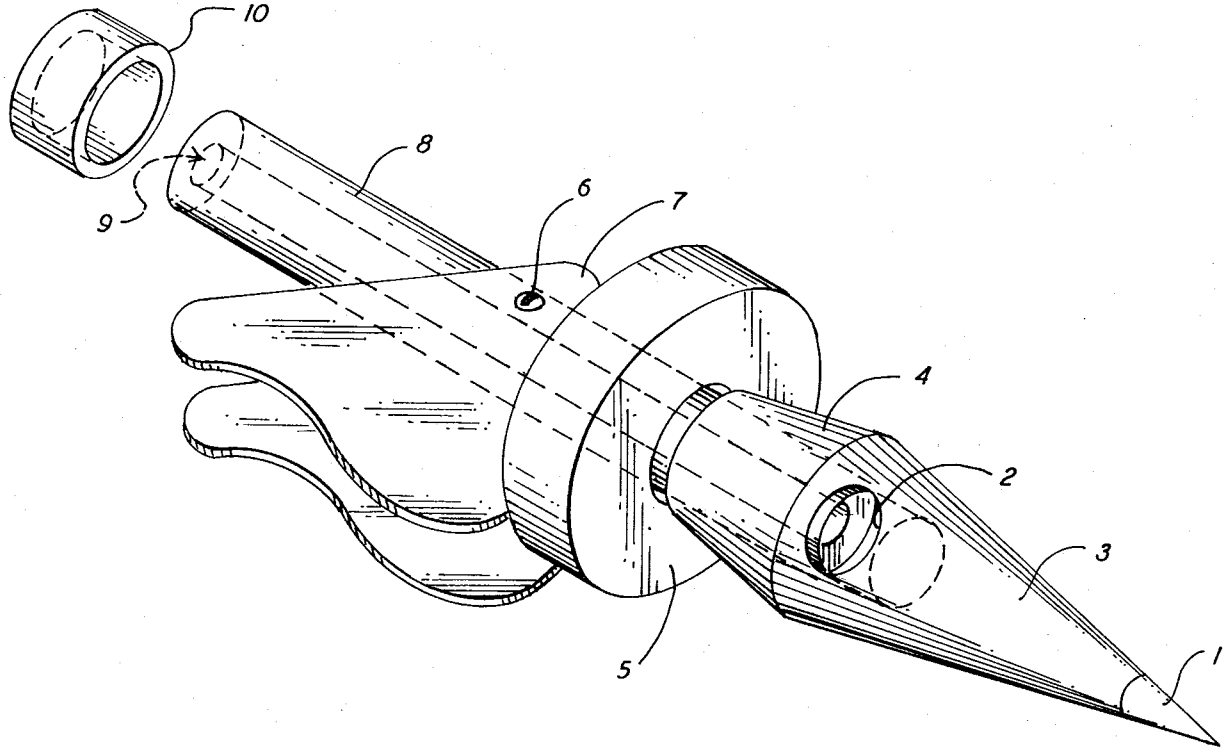
1
2
3
4
5
6
7
8
9
10

DISPENSER AND METHOD FOR TRANSPORTING POURABLE MATERIALS

This application is a continuation of application Ser. No. 774,062, filed Sept. 9, 1985, now abandoned.

BACKGROUND OF INVENTION

1. Field of invention

The present invention pertains to a dispenser and a method for dispensing pourable materials from a container. A dispenser is embedded into a container wall and manipulated so as to seal the dispenser to the container wall. Pourable material may then be transported from the container via the dispenser without leakage. The dispenser may then be resealed.

2. Related Art

Heretofore dispensers have been known to be useful in a variety of applications, including alleviating the common aggravations of serving food. Without them, for example, people frequently spill milk from full gallon containers. Moreover, people frequently open the wrong side of milk cartons. People frequently spill sugar from bags while attempting to fill sugar bowls. In non-food applications, people frequently spill oil from oil cans while attempting to refill their automobile engines. The problem is clear—containers are made primarily for containing, and dispensing is often, at best, a secondary consideration.

Previous attempts have been made to design dispensers, however, such devices have had limited practicality or have been too complicated. Some have had numerous moving parts, each subject to failure, thereby doing little to instill confidence that the solution is better than the problem. U.S. Pat. No. 2,267,154 is an example of a solution having numerous moving parts. Cost has been another factor. Where the expense for solving the problem is comparatively great, the consumer may reasonably prefer the aggravation. For example, U.S. Pat. No. 4,483,464 requires a special container with a thermoadhesive plastic film portal for sealing with the dispenser. Prior art devices such as that in U.S. Pat. Nos. 2,245,698 and 3,305,135 describe piercing the container wall with a dispenser and draining the container's contents, but do not disclose a method or means for conveniently resealing the container, for example, to protect the remaining food from spoilage. Other prior art devices, such as that in U.S. Pat. No. 2,751,114, do not form an effective seal with the container. One example where this problem is particularly apparent is oil can spouts which are used to transport oil from a can to an automobile engine. Although the problem seems simple, its solution has not been simple, and as a result, it has not been solved.

Accordingly, it is an object of the present invention to provide a simple, inexpensive and useful dispenser for dispensing either liquids or pourable non-liquids.

It is a further object of the present invention to provide a dispenser which is practically useful for containers made of materials such as paper, plastic or the like.

It is another object of the present invention to provide a dispenser which is self-sealing to container walls.

It is another object of the present invention to provide a dispenser which is resealable.

It is yet another object of the present invention to provide, via the use of such a dispenser, a method for transporting pourable material in a container which has been changed to make it pourable.

SUMMARY OF THE INVENTION

In accordance with the above objectives, an embodiment of this invention is a dispenser having a projection means located at one end of the dispenser for insertion into a container having at least one wall. An outlet is located at an opposite end for dispensing the contents of the container. A sealing means is located intermediate the ends for sealing against a surface of the container wall. The surface may be an internal surface of the container. A passage, extending from adjacent the one end to the outlet, communicates the interior of the container with the outlet. Puncture means located at the insertion end may be used for piercing the container wall.

Means for biasing the sealing means against the container wall may include a second sealing means located intermediate the first sealing means and the outlet for sealing against an outer surface of the container wall. The biasing means may also include a cam rotatably mounted intermediate the second sealing means and the outlet for biasing the second sealing means against the first sealing means. Control means may also be used to interrupt the communicating.

This invention also includes the combination having a container with at least one wall and a dispenser as described above.

This invention further includes a method for transporting pourable materials, having the steps of inserting a dispenser in a wall of a container, sealing the dispenser to a wall of the container, and transporting contents of the container. The wall or surface may be an inside wall of the container. The method may further include the steps of piercing the container and sealing the dispenser to an outside wall of the container.

Other aspects of the present invention will become apparent from the description which follows, when taken in conjunction with the accompanying drawing.

BRIEF DESCRIPTION OF THE DRAWING

FIG. 1 is a perspective view showing the outer appearance of a dispenser according to the present invention.

DETAILED DESCRIPTION OF THE INVENTION

Referring to FIG. 1, one embodiment of the dispenser has a projector 1, which is designed for piercing a container wall. The projector may also be used to create a hole in the top of a container, where a particular application requires air to quickly replace the contents of the container while it is being drained. However, in typical home uses, an air hole is generally unnecessary for squeezable or deformable containers, such as orange juice or sugar containers.

A projector extension 3 is attached to projector 1 so as to form a conical shape. This shape is one of many shapes suitable for expanding the diameter of the hole pierced in the container wall. Projector extension 3 also contains an inlet 2. It is through inlet 2 that pourable materials will enter the dispenser housing 8 and be transported to outlet 9. Control means 10 can be any means for resealing the dispenser, such as a valve, hinged flap, etc. In FIG. 1, the control means is illustrated as a cap.

Inside pressure grip 4 abuts against the circumference of projector extension 3. The inside pressure grip 4 is made of a deformable material, such as a non-porous rubber, and preferably shaped with a diameter that decreases from the projector extension 3. As subsequently explained, the inside pressure grip is used to form an internal seal between the wall of the container and the dispenser.

Slidably mounted on the dispenser housing 8, is outer supporting washer 5. Outer supporting washer 5 may be made of a rigid or slightly deformable material. As subsequently explained, slidable washer 5 is used to form an external seal between the wall of the container and the dispenser.

Pressure arm 7 acts as a cam which is rotatably mounted on arm rivet 6 to the dispenser housing 8. As pressure arm 7 is rotated, washer 5 is moved in the direction of the inside pressure grip 4.

A method for using the dispenser of FIG. 1 involves partially imbedding the dispenser in an opening in the wall of a container. The projector of FIG. 1 is inserted into the container until the container wall has passed over the projector extension 3, the inlet 2, and the inside pressure grip 4. When the container wall is located between the inside pressure grip 4 and the outer supporting washer 5, pressure arm 7 may be rotated. This rotation causes the outer supporting washer 5 to move in the direction of the inside pressure grip 4, thereby pinching the container wall between the outer supporting washer 5 and the inside pressure grip 4. As the pressure arm 7 is rotated further, the inside pressure grip 4 deforms and reciprocates against the container wall, which in turn, reciprocates against the outer supporting washer 5. This reciprocation forms an internal and an external seal with the container wall. After the pressure arm 7 has been rotated into a fixed position, materials can be transported to or from the container via the dispenser.

The components for the dispenser in FIG. 1 must, of course, be made of materials suitable for the dispenser's use. For example, food handling requires material that will not contaminate the food. Further, the materials should be easy to sanitize and of sufficient strength to endure the wear and tear of kitchen environments or other heavy use environments. In addition to strength, the materials should be resistant to the heat of a dish washer and the chemical and abrasive properties of cleansing agents.

The inside pressure grip 4 must be made of a deformable, non-porous material, such as certain rubbers or plastics. The outer supporting washer 5 may be made of a slightly deformable material, but a material such as plastic is quite adequate. The means for attaching the pressure arm 7 to the dispenser will require particular strength. For example, arm rivet 6 may be comprised of a suitable metal or alloy.

I claim:

1. A device for piercing a wall of a container and for dispensing pourable material from the container, the device containing:

a dispenser housing having an inlet end, an outlet end, and an internal passageway extending from the inlet end to the outlet end;

a projection formed on the inlet end of the dispenser housing, the projection having a piercing tip and an outer surface tapering from the piercing tip to a plane of maximum cross section, said outer surface having an inlet port communicating with the internal passageway;

an annular pressure grip of elastomeric material surrounding the dispenser housing adjacent to the plane of maximum cross section of the projection, the pressure grip having an outer surface with a cross section conforming to the maximum cross section of the outer surface of the projection and tapering toward the outlet end of the dispenser housing to a plane of minimum cross section; a supporting washer slidably mounted on the dispenser housing between the pressure grip and the outlet end of the housing, the supporting washer being made of the material harder than the material of the pressure grip; and means for urging the supporting washer toward the pressure grip with sufficient force to compress the annular pressure grip axially and to correspondingly expand the pressure grip radially.

2. A combination of a container and a device for piercing a wall of the container and for dispensing pourable material from the container, the combination having:

a container having at least one wall for containing pourable materials; and a dispenser for transporting the pourable materials from the container, the dispenser having:

a dispenser housing having an inlet end, an outlet end, and an internal passageway extending from the inlet end to the outlet end for transporting the pourable materials;

a projector formed on the inlet end of the dispenser housing, the projector having a piercing tip and an outer surface tapering from the piercing tip to a plane of maximum cross section, said outer surface having an inlet port communicating with the internal passageway;

an annular pressure grip of elastomeric material surrounding the dispenser housing adjacent to the plane of maximum cross section of the projector, the pressure grip having an outer surface with a cross section conforming to the maximum cross section of the outer surface of the projector and tapering toward the outlet end of the dispenser housing to a plane of minimum cross section; a supporting washer slidably mounted on the dispenser housing between the pressure grip and the outlet end of the housing, the supporting washer being made of the material harder than the material of the pressure grip; and means for urging the supporting washer toward the pressure grip with the sufficient force to compress the annular pressure grip axially and to correspondingly expand the pressure grip radially.

3. A method for dispensing the contents of a container, the method having the steps of:

(a) inserting a dispenser into a container wall, the dispenser having:

a dispenser housing having an inlet end, an outlet end, and an internal passageway extending from the inlet end to the outlet end for transporting the pourable materials;

a projector formed on the inlet end of the dispenser housing, the projector having a piercing tip and an outer surface tapering from the piercing tip to a plane of maximum cross section, said outer surface having an inlet port communicating with the internal passageway.

an annular pressure grip of elastomeric material surrounding the dispenser housing adjacent to the plane of maximum cross section of the projector, the pressure grip having an outer surface with a cross section conforming to the maximum cross section of the outer surface of the projector and tapering toward the outlet end of the dispenser housing to a plane of minimum cross section; a supporting washer slidably mounted on the dispenser housing between the pressure grip and the outlet end of the housing, the supporting washer being made of the material harder than the material of the pressure grip; and means for urging the supporting washer toward the pressure grip with sufficient force to compress the annular pressure grip axially and to correspondingly expand the pressure grip radially;

(b) sealing the dispenser to the container wall by urging the supporting washer toward the pressure grip with sufficient force to compress the annular pressure grip axially and to correspondingly expand the pressure grip radially; and (c) dispensing the contents from the container via the dispenser.

* * * * *